United States Patent [19]

Theilacker et al.

[11] Patent Number: 4,757,702

[45] Date of Patent: Jul. 19, 1988

[54] BENDING AND TWISTING APPARATUS AND METHOD FOR PRINTING MACHINE THREADING TUBE

[75] Inventors: Klaus Theilacker, Friedberg; Michael Wörner, Neusaess, both of Fed. Rep. of Germany

[73] Assignee: M.A.N. Roland Druckmaschinen Aktiengesellschaft, Augsburg, Fed. Rep. of Germany

[21] Appl. No.: 883,129

[22] Filed: Jul. 8, 1986

[30] Foreign Application Priority Data

Jul. 26, 1985 [DE] Fed. Rep. of Germany ..... 3526811

[51] Int. Cl.[4] ..... B21D 7/04

[52] U.S. Cl. ..... 72/152; 72/370; 72/150

[58] Field of Search ..... 72/152, 155, 159, 154, 72/151, 149, 64, 371, 370, 466, 150; 29/423, 157.3 AH

[56] References Cited

U.S. PATENT DOCUMENTS

| | | | |
|---|---|---|---|
| 127,436 | 6/1872 | Smith | 72/64 |
| 174,608 | 3/1876 | Wright | 72/466 |
| 757,592 | 4/1904 | Atwood | 72/369 |
| 2,188,755 | 1/1940 | Markuson | 72/64 |
| 2,412,795 | 12/1946 | Abrahamsen | 72/64 |
| 2,740,454 | 4/1956 | Fuchs, Jr. | 72/466 |
| 2,743,756 | 5/1956 | Fredericks | 72/371 |
| 2,762,415 | 9/1956 | Franck | 72/158 |
| 3,299,681 | 1/1967 | Hautau | 72/155 |
| 3,417,602 | 12/1968 | Schmitt | 72/466 |
| 4,370,927 | 2/1983 | Fischer | 101/228 |
| 4,608,849 | 9/1986 | Brugman | 72/150 |

FOREIGN PATENT DOCUMENTS

| | | | |
|---|---|---|---|
| 0038450 | 10/1983 | European Pat. Off. . | |
| 2739732 | 3/1979 | Fed. Rep. of Germany . | |
| 3238264 | 4/1984 | Fed. Rep. of Germany . | |
| 27558 | 12/1967 | Japan | 72/466 |
| 97426 | 6/1983 | Japan | 72/466 |
| 301542 | 12/1928 | United Kingdom | 72/370 |
| 837462 | 6/1960 | United Kingdom | 72/466 |

*Primary Examiner*—Daniel C. Crane

*Attorney, Agent, or Firm*—Frishauf, Holtz, Goodman & Woodward

[57] ABSTRACT

The guide tube (16) is formed with a longitudinal slit which can be bent about a bending drum (6) of standard construction. In order to additionally introduce a longitudinal or spiral twist, a twisting element can be clamped about the tube, to introduce a twist, manually (FIGS. 1, 2), or upon rotating of the bending drum or disk (FIGS. 7, 8) by a coupled gearing. To retain the slit of the tube in proper dimension and alignment, and prevent deformation of the tube, a counter element with a groove (5) therein matched to the circumference of the tube is provided, and an insert strip (18) is located within the tube, which insert strip preferably has externally projecting portions (18*a*) for guidance of the strip between the counter element and the bending tube or disk, and a recessed portion (18*b*) extending within the slit (17) to prevent deformation of the tube and of the slit during twisting and/or bending of the tube.

11 Claims, 3 Drawing Sheets

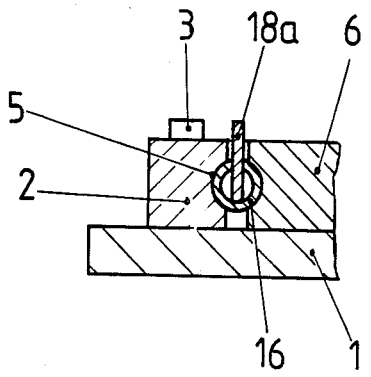
FIG. 3
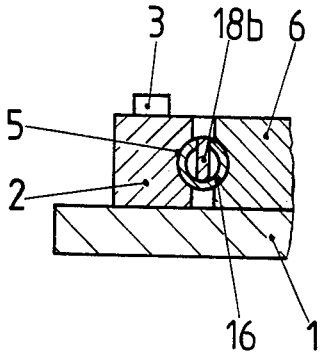
FIG.4
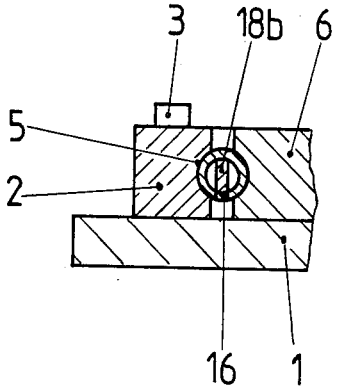
FIG.5
FIG.6
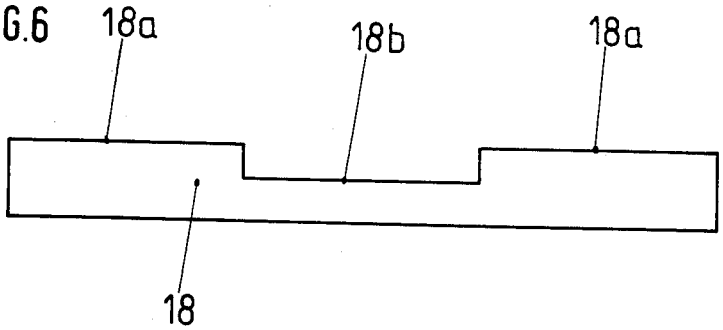

FIG.7
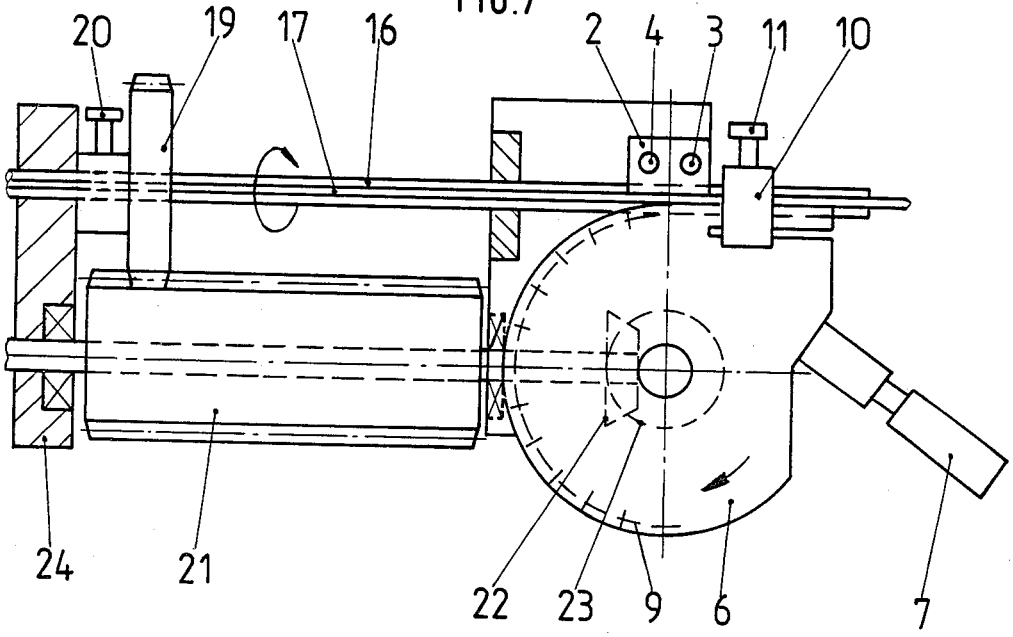
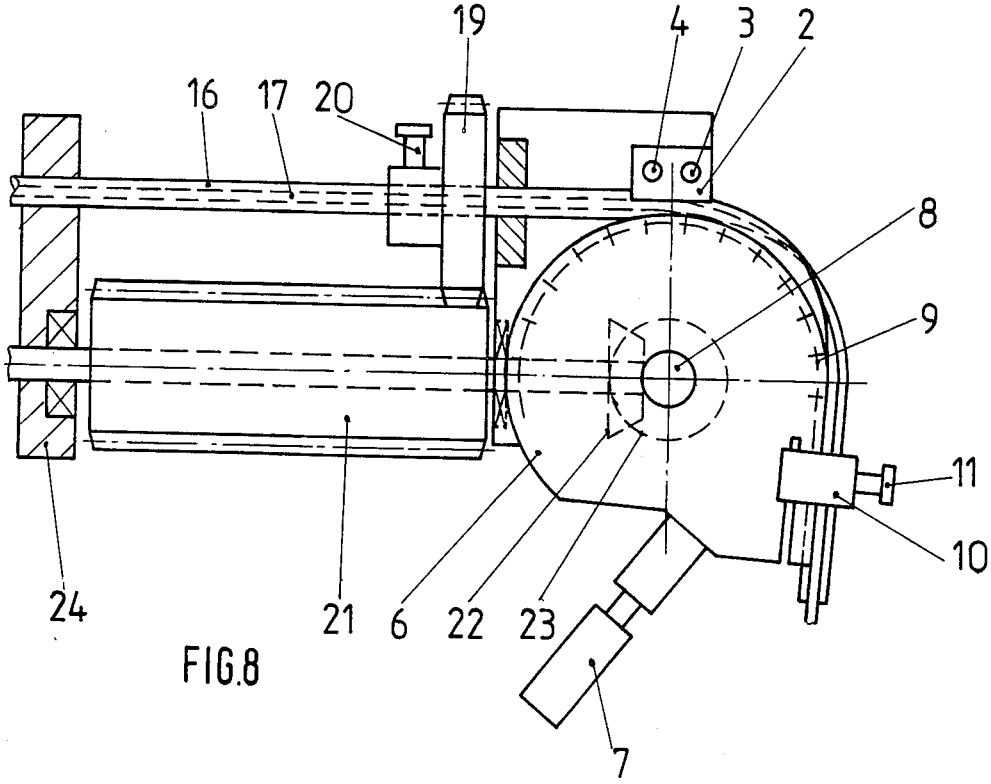
FIG.8

BENDING AND TWISTING APPARATUS AND METHOD FOR PRINTING MACHINE THREADING TUBE

The present invention relates to printing machinery which includes apparatus capable of threading a web of paper through the machine, described, for example, in the referenced U.S. Pat. No. 4,370,927—the disclosure of which is hereby incorporated by reference—and more particularly to an apparatus to bend and twist a guide tube for the threading apparatus.

BACKGROUND

The referenced U.S. Pat. No. 4,370,927, FISCHER, describes a threading apparatus for a rotary printing machine to thread webs therein. The structure includes a tubular guide, within which a threading element, fitting within the tubular guide, can be pulled. The tubular guide is formed with a longitudinal slit through which a holder bracket for paper webs to be threaded into the machine can extend. Preferably, and as disclosed, the tubular guide has circular cross section. Threading apparatus of this kind enables paper webs or other webs in which printing is to be done to be threaded in a rotary printing machine and, further, to guide the web accessory or auxiliary apparatus, for example about turning rods, guide rollers, and the like. If the web is to be guided about turning rods and the like, it is necessary that the web not only must be looped about the rod but, if the guide rods are located at an angle with respect to the longitudinal extent of the web, the threading element must, additionally, be twisted so that the longitudinal slit will follow the path of the web. Otherwise, the web will not follow an angular path as determined by a guide rod or guide roller which is positioned at an angle with respect to the web.

In the past, guide rod sections which required a spiral slit therein were made specially by a process similar to cutting a long spiral slit into a rod, that is, by a process similar to forming a spiral thread. A longitudinal as well as rotary movement was impressed on a guide section, resulting in a hollow segment of the guide rod in which the slit extended in a spiral direction, similar to the path of a flank of a thread, which could guide a pull element about an angularly positioned turning rod, guide roller or the like.

As can readily be seen, manufacturing such guide elements specially on a machine which provides for conjoint rotary as well as longitudinal feed of a cutting element is expensive. Additionally, if at the same time the guide element is to be bent further operating or working steps are necessary.

THE INVENTION

It is an object to provide a bending apparatus for a tubular guide for use in a paper threading apparatus in which the paper threading element can extend through a slit of the tubular apparatus and be movable in three dimensions, that is, to provide an apparatus in which bending of the tubular structure and twisting about its longitudinal axis can be readily and easily accomplished, preferably in a single working step and with low cost.

Briefly, a bending drum or disk of customary construction, having a circumferential zone about which the tubular threading element can be bent, is formed with an arrangement to clamp the tube at a circumferential location, so that, upon exertion of a bending force, the tube can be bent about the circumferential zone. The clamping arrangement also constrains the tube against twisting.

In accordance with a feature of the invention, a filler element is fitted into the tube, the filler element being formed with a ridge or strip which engages in the slit. The filler element may, for example, be a longitudinal strip, fitting within the tube and having an end portion defining said ridge or strip and fitting into the slit. A twisting clamp is placed about the tube and, as the tube is bent about the circumferential zone of the bending disk or drum, a twisting force is applied to the clamp, for example by a lever attached thereto, to simultaneously bend the tube and twist it about its longitudinal axis. Deformation of the slit and of the tube is prevented by the ridge or strip fitting within the slit.

In accordance with a preferred form of the invention, the strip or slit may have portions extending beyond and through the slit, for example for ease of gripping with a clamping arrangement. In accordance with another feature of the invention, an apparatus can be provided for imparting the twist, for example by clamping the tube to a gear element which can travel along an axially elongated gear, and which is rotated as the tube is also bent about the bending drum.

DRAWINGS

FIG. 3 is a cross section along line A—A of FIG. 1, with the internal element inserted in a position in which an external part projects outside of the slit;

FIG. 4 is a cross section along line A—A of FIG. 1, with the insert strip shifted axially;

FIG. 5 is a cross section along line B—B of FIG. 2;

FIG. 6 is a side view of a filler element;

FIG. 7 is a side view of an automatic apparatus for bending and twisting a tube prior to starting the bending-and-twisting operation; and FIG. 8 shows the portion of the apparatus of FIG. 7 after a bend and twist has been completed.

DETAILED DESCRIPTION

Figure 1:
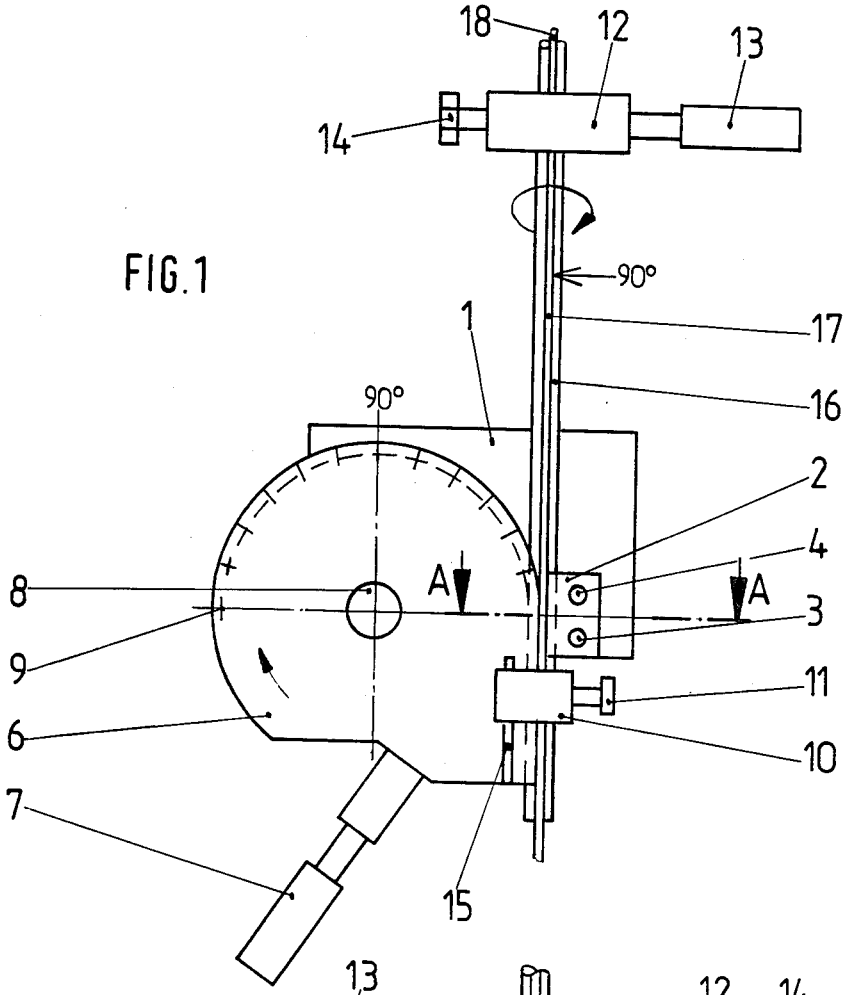
FIG. 1 is a side view of the apparatus illustrating the placement of a tube prior to bending and twisting the tube.
Figure 2:
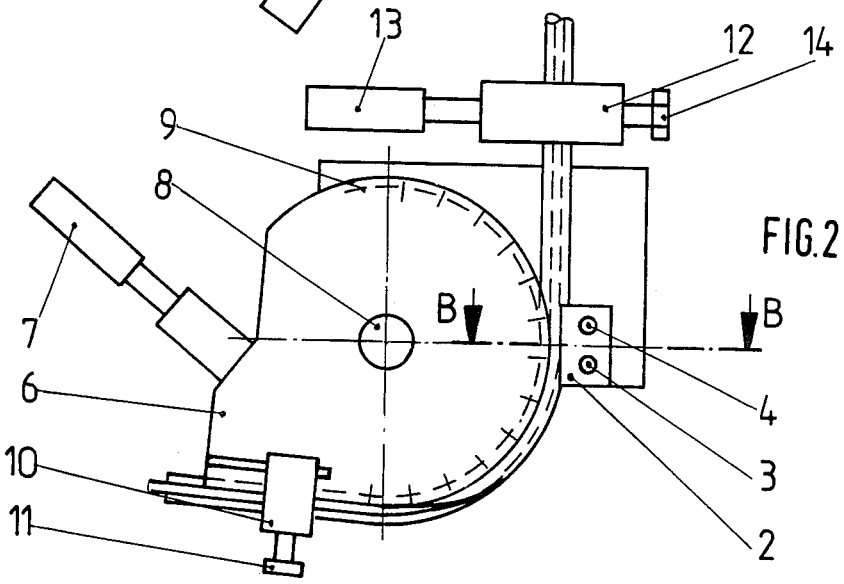
FIG. 2 illustrates the apparatus of FIG. 1 during the bending and twisting operation and showing, for example, a bend of about 90° and a twist of about 180°.

Referring first to FIGS. 1, 2 and 6: A tubular element 16, formed with a longitudinal slit 17, is to be bent and twisted. The apparatus, in its simplest form, utilizes a fixed base 1, which may, for example, be secured in a vise or the like. The fixed base 1 has rotatably journalled thereon a bending disk or drum 6 which has a circular circumferential zone about which the tube 16 is to be bent. A counter bearing element 2 is secured to the base plate 1 by screws 3, 4. The sectional views FIG. 3–5 show the arrangement, and the shape of the circumferential zone of the disk or drum 6 and of the counter bearing element 2 where it is engaged by the tube 16. As can be seen, the disk or drum 2 has an outer groove or relieved surface into which the tube 16 can fit; similarly, the counter element 2 is formed with a recess or groove 5 to receive the part of the tube 16 not located in the outer groove of the disk or drum 2. The groove 5 in the counter element is located opposite the groove of the disk or drum 6. The disk or drum 6 is coupled to a lever 7 by which the disk or drum can be rotated.

A bearing 8 secures the bending disk to the base plate 1. The bending disk 6 has a scale 9 secured thereto so that the bending angle of the tube can be readily determined, for example by matching the scale to a bench mark on the base plate 1. The disk 6 is formed with a slit 15 on which a clamp 10 is slidably arranged, the clamp 10 including a screw 11 which can be tightened against a portion of the tube 18 to retain the tube 18 in position on the disk 6.

The arrangement thus far described is smaller to well known tube bending apparatus. In accordance with a feature of the present invention, it can be used to bend and, further, twist a longitudinally slit tube. In accordance with the invention, a twisting arrangement is provided formed by a clamp 12, a lever 13 coupled thereto and a screw 14 to clamp the clamp 12 against the circumference of the tube 18. The clamp 12, in cross section, may be split and have a tubular interior opening to fit around the tube 16. Upon tightening of the screw 14 against the tube 16, the tube 16 can be securely clamped in the clamp 12, immovably, both with respect to rotation as well as longitudinal sliding along the tube 16.

In accordance with a feature of the invention, a filler strip 18 (FIG. 6) is placed into the tube 16. The filler strip 18 has a width which corresponds at least approximately to the width of the slit 17 in the tube 16. In a preferred form, the filler strip 18 has two differently dimensioned regions, a region 18*a* which is higher than the diameter of the tube 16, so that a portion of the region 18*a* will extend outwardly of the slit, that is, therebeyond, as best seen in FIG. 3. A depressed region 18*b* is located between the higher regions 18*a*—see FIG. 6—which leaves, however, a height dimension sufficiently large to extend diametrically across the interior of the tube 16 and through the slit 17, terminating, for example, flush with the outer diameter of the tube 16 in the region of the slit 17—see FIG. 4. The length of the recessed portion 18*b* should extend through the region in which the tube 16 is to be twisted.

BENDING AND TWISTING OF TUBE 16:

FIG. 3 illustrates the position of the filler strip 18 in which the portion 18*a* extends through the slit 17. The counter plate 2, together with the disk 6, forms a gap which is just slightly larger than the width of the region 18*a*. The gap and the counter plate 2 provide for exact guidance of the tube 16 to be twisted. Inner stresses in the tube 16, upon bending about the disk 6, thus cannot deform the tube in an undesired pattern. Undesired twist of the tubes during the bending, thus, is avoided.

The tube is bent by moving the lever 7—compare FIGS. 1 and 2—to thereby rotate the disk 6. The extent of bending can be read off scale 9. Twisting of the tube 16 requires placement of the strip 18 in such a manner that the relieved portion 18*b* can pass within the grooves at the circumference of the disk 6 and the groove 5 in the counter element 2, respectively, thereby permitting twisting of the tube 16 between the counter plate 2 and the recess 5 thereof, as best seen in the cross-sectional views of FIGS. 4 and 5. FIG. 4 illustrates the placement of the tube at the initiation of the twisting operation, and FIG. 6 the placement, for example, of the leading edge of the recessed portion 18*b*, after the tube has been twisted. The tube is twisted by providing a twisting force to lever 13 on the clamp 12.

In accordance with a preferred feature, the degree of twist, for example a 90° bend or a 180° bend, is marked on the tube 16—as indicated, for example, in FIG. 1. Upon twisting of the lever 13 about the longitudinal axis of the tube 16, the tube 16 will be twisted by the desired amount. Conjoint bending and twisting is shown, in cross section, in the initial portion in FIG. 4. At the depressed portion of the strip 18, at the ridge or rib defining the end of the recess 18*b*, the rib will extend into the slit 17 of the tube 16, but does not project beyond the outer circumference of the tube 16—in contrast to FIG. 3, where the portion 18*a* extends outside of the slit 17. Consequently, the tube 16 can be bent about the disk 6 while being twisted, the counter element 2 guiding the tube about the disk 6, while permitting twisting thereof. Of course, it is possible to merely twist the tube and not operate the lever 7 to simultaneously bend the tube. Twisting and/or bending of the tube 16 can be carried out reliably without deformation of the slit 17 due to the presence of the strip 18 therein. A cross-sectional view of FIG. 5 shows the position of the tube, with the slit rotated 180° with respect to the illustration in FIG. 4, that is, corresponding to a 180° twist of the tube about its own axis.

The twisting and bending operation by the apparatus of FIGS. 1 and 2 is entirely manual. A somewhat more complex apparatus, requiring only operation of one lever, is shown in FIGS. 7 and 8.

FIG. 7 illustrates the starting position and FIG. 8 the final position of a semi-automatic bending-and-twisting apparatus. A gear 19 is clamped by a screw 20 to the tube 16, gear 19 and screw 20 replacing the clamp-and-lever arrangement 12, 13, 14 of FIGS. 1 and 2. The gear 19 is in engagement with an elongated gear 21 which, in turn, is driven by a pair of bevel gears 22, 23 from the bending disk or drum 6. The degree of bending by the disk or drum 6 and the degree of twist thus is determined by the gear ratio of the gears 22, 23. The gear ratio can, additionally, be changed of course by changing the gear ratio of gears 21, 19. Gear 21 and tube 16 are guided in a fixed end plate 24.

To operate the apparatus, the lever 7 is moved. Rather than using a lever 7, a motor can be coupled to the shaft of the disk 6. Upon rotation of the disk 6, the gear 19 will twist and, simultaneously, travel longitudinally or traverse axially along the gear 21.

It is, of course, equally possible to use fillers 18 which are uniform and are only of the width of the portion 18*b*, that is, without the extending portions 18*a*, if the tube 16 can be clamped at the initial point or region of the twist by any other arrangement, for example by a constraining path and a clamping element clamped on the tube 16; any other arrangement which prevents uncontrolled twisting of the portion of the tube which is not clamped in the clamp 12, 14, 13 or the gear 19 and clamp 20 may be used.

Various changes and modifications may be made within the scope of the inventive concept.

We claim:

1. The combination of a workpiece which consists of an elongated tubular structure formed with a longitudinal slit (17) to form a slit threading tube (16)

with bending and twisting apparatus for selectively bending, twisting, and both bending and twisting said slit tube while maintaining the integrity of the slit (17), and with a strip-like filler element (18) located in, and extending transversely within the tube (16) and being formed with a ridge (18*a*, 18*b*) extending into the slit (17), wherein the apparatus comprises a base (1);

a bending disk or drum (6) rotatably secured to the base, and formed with an outer circumferential groove for receiving the tube, in a circumferential zone for bending the tube (16) about its circumference;

means (10, 11) for clamping a tube portion on a circumferential location of the drum (6) and for restraining twist of the tube with respect to the drum at said location;

counter bearing means (2, 3, 4) secured to the base for constraining the tube (16) to follow a circumferential zone of the drum upon rotation thereof including a fixed counter bearing element (2) formed with a groove (5) dimensioned and shaped to partly circumferentially receive the slit tube (16) and, in combination with said groove on the drum, guide said tube upon rotation of the drum during twisting of the tube;

twisting means (12, 13; 19, 20) clamped to the slit threading tube (16) at a longitudinal position thereon remote from said circumferential location for twisting the slit threading tube with the filler element therein about its longitudinal axis, and wherein said filler element (18) is formed with a depressed portion (18*b*) dimensioned to fit across the interior of the tube and extending into the slit and not beyond the outer surface of said tube (16) in those regions where the slit tube (16) is to be twisted to, selectively, fit into the groove of the drum or of the counter bearing element;

said filler element (18) being further formed with at least one portion (18*a*) adjacent the depressed portion dimensioned to project outside of said slit (17) in those regions where the tube will not be twisted;

said depressed portion (18*b*) of the filler element (18) permitting twisting of said tube while the tube is partly received in said groove (5) of said counter bearing element (2);

said filler element (18) being bent, or twisted, or bent and twisted with the tube (16) upon bending, or twisting, or bending and twisting of the tube and preventing deformation of said slit (17).

2. The combination of claim 1, further including operating means (7) coupled to the disk or drum (6) for rotating the disk or drum to bend the tube about the circumferential zone of the bending disk or drum, while permitting twisting of the tube upon rotating the twisting means about the longitudinal axis of the tube.

3. The combination of claim 1, further comprising a lever handle (13) coupled to the twisting means to provide for levered force application on said twisting means.

4. The combination of claim 1, further including an angle scale (9) secured to the disk or drum to indicate a bending angle about said circumferential zone of a tube placed against said zone.

5. The combination of claim 1, wherein the counter bearing means includes a block (2) secured to the base and located for the part-circular groove (5) to receive another portion of the tube (16), said other portion being diametrically opposite the portion of the tube engaging said disk or drum.

6. The combination of claim 1, wherein the twisting means includes a gear (19) clamped about the tube, and a gearing system (21, 22, 23) coupling the bending disk or drum (6) to said gear (19) to provide for conjoint bending of the tube about the disk or drum and twisting of the tube about its longitudinal axis.

7. The combination of claim 6, wherein the degree of twist of the tube and the bend angle is determined by the gear ratio of said gearing system.

8. The combination of claim 6, wherein said gear system comprises replaceable gears (21, 22, 23) to selectively adjust the twist angle in relation to the bending angle for the twist and bend of the tube.

9. The combination of claim 1, wherein the depressed portion (18*b*) of the filler element has a width dimension corresponding approximately to the interior diameter of the tube (16) plus the wall thickness of the tube so that said portion of the filler element will fit within the tube, and includes an edge portion, defining said ridge or strip, which fits within said slit (17).

10. The combination of claim 1, wherein said circumferential groove in the drum (6) partly circumferentially receives the tube (16) and is complementary to said groove (5) in the counter bearing means.

11. A method of bending and twisting a workpiece which consists of an elongated tubular structure formed with a longitudinal slit (17) to form a slit threading tube, utilizing an apparatus having a base (1);

a bending disk or drum (6) rotatably secured to the base and formed with a circumferential zone for bending the tube (16) about its circumference;

means (10, 11) for clamping a tube portion on a circumferential location of the drum at said zone and for restraining twist of the tube with respect to the drum at said location;

a counter bearing element (2, 3, 4) secured to the base for constraining the tube (16) to follow said circumferential zone of the drum upon rotation thereof; and twisting means (12, 13; 19, 20) clamped to the slit threading tube (16) at a longitudinal position thereon remote from said circumferential location, comprising the steps of backing a portion of the circumference of said tube by a groove formed in said bending disk or drum, and a counter groove (5) formed in the counter bearing element (2);

introducing into the slit tube a strip-like filler element (18) formed with a depressed portion (18*b*) dimensioned to fit across the interior of the tube and extending into the slit, but not beyond said slit, in those regions where the slit tube (16) is to be twisted, said filler element further being formed with a portion (18*a*) adjacent said depressed portion and dimensioned to project outside of the slit in those regions where the tube is not to be twisted;

said step of introducing said filler element further comprising introducing said filler element into the tube with the depressed portion positioned in the region where the tube, upon being bent about the circumference of said bending disk or drum, moves relative to said counter bearing element (2) and additionally twists with the tube surface adjacent said slit fitting into at least one of said grooves without interference from said filler element maintaining the integrity of said slit; and bending and twisting said tube by conjointly operating said bending disk or drum and said twisting means, with the filler element in said tube, and maintaining the integrity of said slit by the presence of the filler element in said slit (17) as the tube is being bent and twisted so that, upon bending and twisting, the depressed portion (18*b*) moves past an adjacent surface of the drum, or counter bearing element, respectively, and thereby preventing mutual interference.

* * * * *